US011107621B2

(12) United States Patent
Jung et al.

(10) Patent No.: US 11,107,621 B2
(45) Date of Patent: Aug. 31, 2021

(54) COIL COMPONENT AND METHOD FOR MANUFACTURING THE SAME

(71) Applicant: SAMSUNG ELECTRO-MECHANICS CO., LTD., Suwon-Si (KR)

(72) Inventors: Jung Hyuk Jung, Suwon-Si (KR); Ki Young Yoo, Suwon-Si (KR); Dong Min Kim, Suwon-Si (KR); Hye Yeon Cha, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 427 days.

(21) Appl. No.: 16/032,689

(22) Filed: Jul. 11, 2018

(65) Prior Publication Data

US 2019/0122811 A1 Apr. 25, 2019

(30) Foreign Application Priority Data

Oct. 24, 2017 (KR) ..... 10-2017-0138683

(51) Int. Cl.

| | |
|---|---|
| ***H01F 27/29*** | (2006.01) |
| ***H01F 17/04*** | (2006.01) |
| ***H01F 17/00*** | (2006.01) |
| ***H01F 27/32*** | (2006.01) |
| ***H01F 5/06*** | (2006.01) |
| ***H01F 5/00*** | (2006.01) |

(52) U.S. Cl.

CPC ..... *H01F 27/292* (2013.01); *H01F 5/003* (2013.01); *H01F 5/06* (2013.01); *H01F 17/0013* (2013.01); *H01F 17/04* (2013.01); *H01F 27/324* (2013.01); *H01F 2005/006* (2013.01); *H01F 2017/0073* (2013.01); *H01F 2017/048* (2013.01)

(58) Field of Classification Search

USPC ..... 336/200, 232

See application file for complete search history.

(56) References Cited

U.S. PATENT DOCUMENTS

| | | | | |
|---|---|---|---|---|
| 5,948,571 | A | 9/1999 | Mih et al. | |
| 2015/0035640 | A1* | 2/2015 | Wang | H01F 27/2804 336/200 |
| 2015/0170823 | A1* | 6/2015 | Jeong | C25D 5/022 336/200 |
| 2016/0071643 | A1* | 3/2016 | Heo | H01F 17/0006 336/200 |

FOREIGN PATENT DOCUMENTS

| | | | |
|---|---|---|---|
| JP | 2002-015917 | A | 1/2002 |
| KR | 10-1999-0066108 | A | 8/1999 |
| KR | 10-0268746 | B1 | 12/2000 |

* cited by examiner

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil component includes a body including a magnetic material; a support member disposed in the body; and a coil pattern on the support member in the body. The coil pattern may include a first conductor layer formed on the support member and having a planar spiral shape; a second conductor layer formed on the first conductor layer and having a volume of a lower portion greater than a volume of an upper portion; and a third conductor layer formed to cover the second conductor layer from the outside of the second conductor layer.

13 Claims, 7 Drawing Sheets

COIL COMPONENT AND METHOD FOR MANUFACTURING THE SAME

CROSS-REFERENCE TO RELATED APPLICATION(S)

This application claims the benefit of priority to Korean Patent Application No. 10-2017-0138683 filed on Oct. 24, 2017, in the Korean Intellectual Property Office, the disclosure of which is incorporated herein by reference in its entirety.

TECHNICAL FIELD

The present invention relates to a coil component, for example, a power inductor and a method for manufacturing the same.

BACKGROUND

An inductor, a coil component, is a representative passive element constituting an electronic circuit together with a resistor and a capacitor to remove noise. The inductor may be classified as a thin film inductor formed using plating, a laminated inductor formed using paste printing, a winding type inductor formed using a winding coil, and the like.

In accordance with the miniaturization and thinning of electronic devices such as digital TVs, mobile phones, notebooks, and the like, a coil component applied to such electronic devices is also recently required to be miniaturized and to have high performance.

In addition, as the thin film inductor may satisfy the requirements of a power inductor used in the electronic device according to the development of a technology for manufacturing an inductor, the thin film inductor is used as the power inductor such that the demand for miniaturization and thinness of the electronic device may be satisfied.

There has been demand for such a thin film inductor to simultaneously satisfy thinness of the coil component as well as high performance and reliability thereof in accordance with recent trends such as complexity, multifunctionalization, slimness, and the like, of sets.

SUMMARY

An aspect of the present disclosure may provide a coil component capable of securing high performance and reliability while being able to be applied to a miniaturized model.

An aspect of the present disclosure may forma coil pattern by sequentially forming first to third conductor layers having a planar spiral shape and make a shape of the third conductor layer uniform by adjusting a width of the second conductor layer according to a height, thereby securing performance of a coil.

According to an aspect of the present disclosure, a coil component may include a body including a magnetic material; a support member disposed in the body; and a coil pattern on the support member in the body. The coil pattern may include a first conductor layer formed on the support member and having a planar spiral shape; a second conductor layer formed on the first conductor layer and having a volume of a lower portion greater than a volume of an upper portion; and a third conductor layer formed to cover the second conductor layer from the outside of the second conductor layer.

According to another aspect of the present disclosure, a method for manufacturing a coil component may include forming a coil pattern on a support member; and covering the support member with a magnetic material to form a body. The forming of the coil pattern may include forming a first conductor layer having a planar spiral shape on the support member; forming a second conductor layer on the first conductor layer; and forming a third conductor layer to cover the second conductor layer from the outside of the second conductor layer. The second conductor layer may have an area of a lower surface wider than an area of an upper surface.

In the summary, all of features of the present disclosure are not mentioned. Various units for solving an object of the present disclosure may be understood in more detail with reference to specific exemplary embodiments of the following detailed description.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
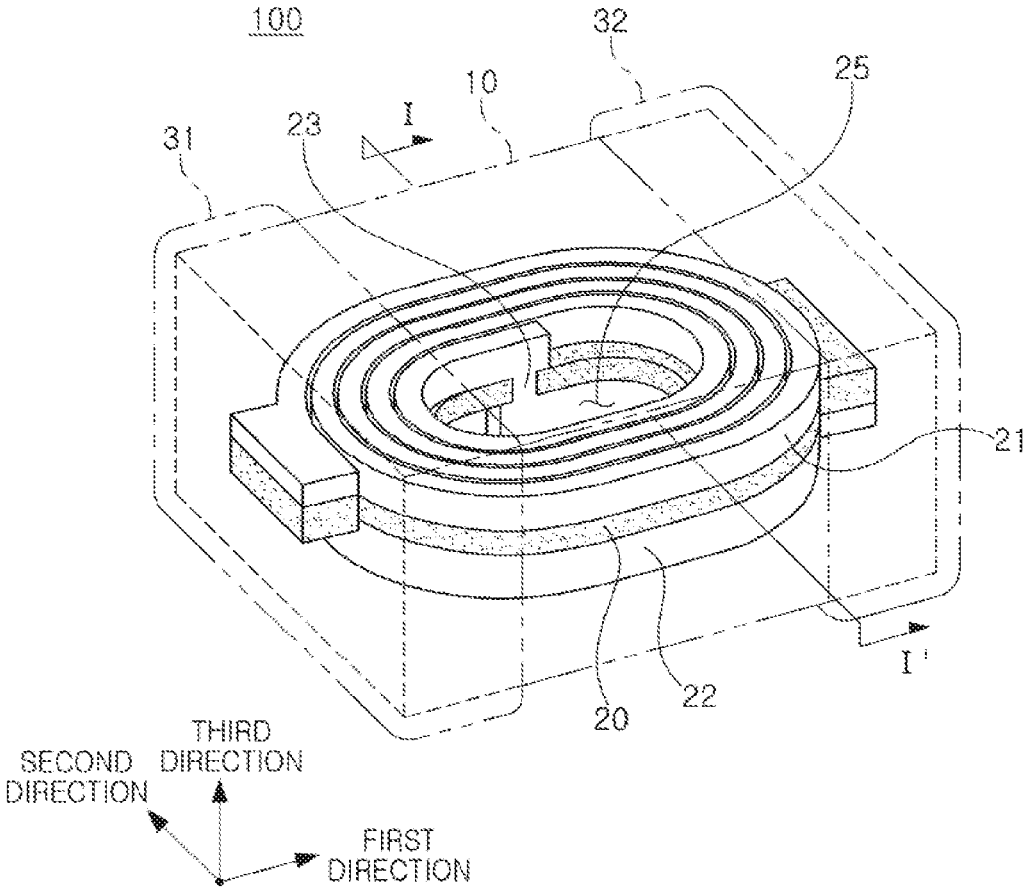
FIG. 1 is a perspective view illustrating one example of a coil component according to an exemplary embodiment in the present disclosure.

Hereinafter, exemplary embodiments of the present disclosure will now be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first connection member is disposed on a level above a redistribution layer. However, the claims are not limited thereto. In addition, a vertical direction refers to the above-mentioned upward and downward directions, and a horizontal direction refers to a direction perpendicular to the above-mentioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

Electronic Device

A coil component according to an exemplary embodiment in the present disclosure means various coil components applicable to an electronic device.

It may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, an SMBC, a liquid crystal display active matrix organic light emitting diode (LCD AMOLED), an audio codec, a universal serial bus (USB) 2.0/3.0 a high definition multimedia interface (HDMI), a CAM, and the like, may be used.

Here, various kinds of coil components may be appropriately used between these electronic components depending on their purposes in order to remove noise, or the like. For example, a power inductor, a high frequency (HF) inductor, a general bead, a bead for a high frequency (GHz), a common mode filter, and the like, may be used.

In more detail, the power inductor may be used to store electricity in a magnetic field form to maintain an output voltage, thereby stabilizing power. In addition, the high frequency (HF) inductor may be used to perform impedance matching to secure a required frequency or cut off noise and an alternating current (AC) component. Further, the general bead may be used to remove noise of power and signal lines or remove a high frequency ripple. Further, the bead for a high frequency (GHz) may be used to remove high frequency noise of a signal line and a power line related to an audio. Further, the common mode filter may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, a smartwatch, or an automobile. The electronic device may also be various other electronic devices well-known to those skilled in the art, in addition to the devices described above.

Coil Component

Hereinafter, a coil component according to the present disclosure, particularly, a power inductor will be described for convenience of explanation. However, the coil component according to the present disclosure may also be applied as the coil components for various purposes as described above.

Meanwhile, a side portion used below is used to mean a direction toward a first direction or a second direction of the drawings for convenience of explanation, and an upper portion is used to mean a direction toward a third direction for convenience of explanation. A lower portion is used as a direction opposite to the third direction for convenience of explanation. In addition, a length direction is used to mean the first direction, a width direction is used to mean the second direction, and a thickness direction is used to mean the third direction.

Meanwhile, a phrase "positioned at the side portion, the upper portion, or the lower portion" has been used as a concept including a case in which a target component is positioned in a corresponding direction, but does not directly contact a reference component, as well as a case in which the target component directly contacts the reference component in the corresponding direction. However, these directions are defined for convenience of explanation, and the claims are not particularly limited by the directions defined as described above.

Figure 2:
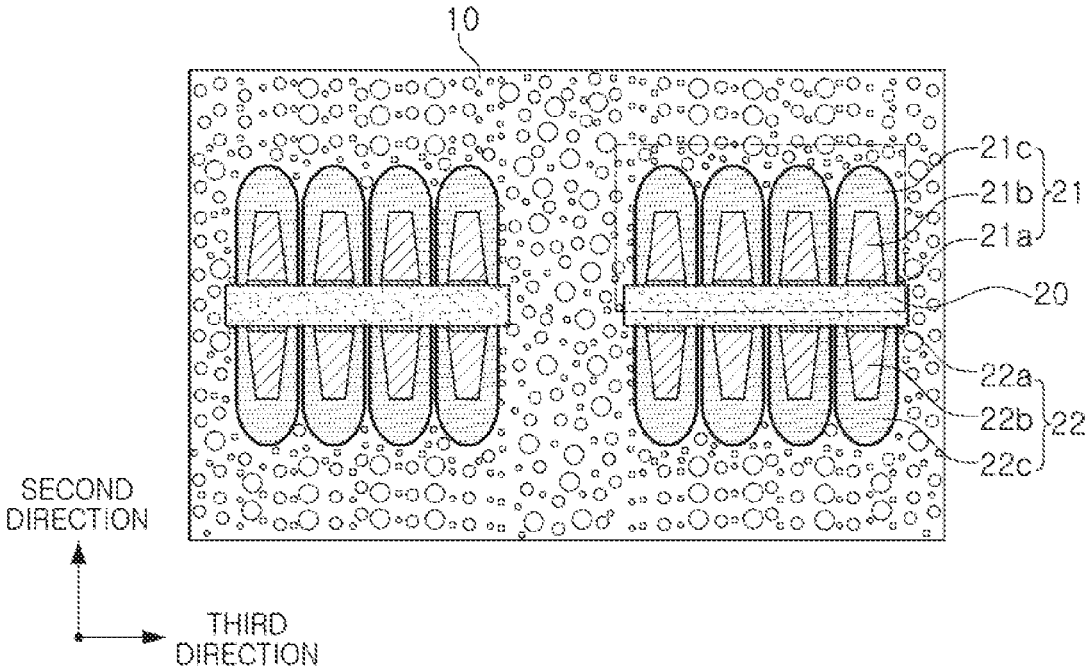
FIG. 2 is a view illustrating an example of a schematic cross section taken along line I-I' of the coil component illustrated in FIG. 1.

FIG. 1 is a perspective view illustrating one example of a coil component according to an exemplary embodiment in the present disclosure and FIG. 2 is a view illustrating an example of a schematic cross section taken along line I-I' of the coil component illustrated in FIG. 1.

Referring to FIGS. 1 and 2, a coil component 100 according to an exemplary embodiment may include a support member 20 disposed in a body 10, first and second coil patterns 21 and 22 formed on an upper surface and a lower surface of the support member 20 in the body 10, respectively, and first and second external electrodes 31 and 32 disposed on the body 10 and connected to the first and second coil patterns 21 and 22, respectively.

The first and second coil patterns 21 and 22 may include first conductor layers 21*a* and 22*a* having a planar spiral shape, second conductor layers 21*b* and 22*b* formed on the first conductor layers 21*a* and 22*a* and having an area of a lower surface greater than an area of an upper surface, and third conductor layers 21*c* and 22*c* covering the second conductor layers 21*b* and 22*b* from the outside of the second conductor layers 21*b* and 22*b*.

As illustrated, the second conductor layers 21*b* and 22*b* may have the area of the lower surface greater than the area of the upper surface.

That is, as illustrated in FIG. 2, the second conductor layers 21*b* and 22*b* may have a width of the lower surface longer than a width of the upper surface, when being viewed from a cut surface in a thickness-width direction of the body 10.

As an example, the second conductor layers 21*b* and 22*b* may have a trapezoidal shape in which a thickness thereof, that is, a height, is greater than a width thereof, when being viewed from a cut surface in a thickness-width direction of the body 10.

As described above, the second conductor layers 21*b* and 22*b* are formed so that an upper portion and a lower portion thereof are different from each other, that is, the upper portion has a smaller volume, such that the third conductor layers 21*c* and 22*c* may be more uniformly formed.

Figure 4:
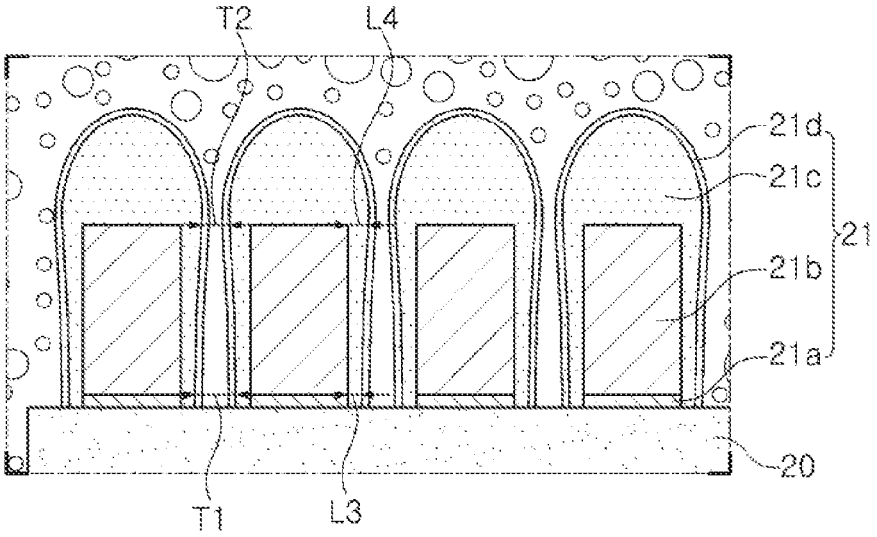
FIG. 4 is an enlarged view of a portion of a coil component according to a comparative example.

FIG. 4 is an enlarged view of a portion of a coil component according to a comparative example. First, a relationship of a shape of the third conductor layer to a shape of the second conductor layer will be described with reference to FIG. 4.

In the comparative example illustrated in FIG. 4, the coil pattern 21 may be disposed on one surface of the support member 20 and may include the first conductor layer 21*a*, the second conductor layer 21*b*, the third conductor layer 21*c*, and an insulating layer 21*d* which are formed in this order.

The coil component according to the comparative example may include the second conductive layer 21*b* formed to have uniform upper and lower portions. Therefore, where plating is performed using such a second conductor layer 21*b* as a leading wire, a plating solution may not be smoothly supplied to a position closer to the support member 20, that is, toward the lower portion of the second conductor layer 21*b*. In particular, as the plating is gradually performed, the plating solution may not be sufficiently supplied to the lower portion of the second conductor layer 21*b* by a bottleneck phenomenon. Accordingly, as illustrated in FIG. 4, the third conductive layer 21*c* may have a volume of an upper portion greater than a volume of a lower portion. That is, a thickness L3 of the third conductor layer 21*c* in the lower portion may be thinner than a thickness L4 of the third conductor layer 21*c* in the upper portion, which results in asymmetry.

Therefore, spacing between the coil patterns 21 in the upper portion and the lower portion may be different from each other. That is, as illustrated in FIG. 4, spacing T3 between the coil patterns in the lower portion may be greater than spacing T4 between the coil patterns in the upper portion. As a result, unexpected mutual influences may be caused between the coil patterns, which may cause a problem in reliability of the coil component.

On the other hand, referring back to FIGS. 1 and 2, in one example of the coil component 100 according to an exemplary embodiment in the present disclosure, the second conductor layers 21*b* and 22*b* may have an area of a lower surface greater than an area of an upper surface. That is, the second conductor layers 21*b* and 22*b* may be asymmetric in a height direction, that is, a thickness direction so that a volume of a lower portion is greater than a volume of an upper portion.

Therefore, according to an exemplary embodiment in the present disclosure, in a case in which the third conductor layers 21*c* and 22*c* are formed by a plating method, even if a plating solution is not smoothly supplied to a position closer to the support member 20, that is, the upper portion of the second conductor layer 21*b*, the coil patterns 21 and 22 themselves may be formed so that the upper portion and the lower portion have a symmetrical volume, which results in improving reliability of the coil component.

Hereinafter, components of the coil component 100 according to one example will be described in more detail with reference to the accompanying drawings.

The body 10 may form a basic outer shape of the coil component 100. The body 10 may include first and second surfaces opposing each other in a first direction, third and fourth surfaces opposing each other in a second direction, and fifth and sixth surfaces opposing each other in a third direction. The body 10 may have an approximately hexahedral shape, but is not limited thereto. Six corners at which the first to sixth surfaces meet each other may be rounded by grinding, or the like.

The body 10 may include a magnetic material exhibiting magnetic characteristics. For example, the body 10 may be formed by filling ferrites or metal magnetic powders in a resin. The ferrite may be a material such as Mn—Zn based ferrite, Ni—Zn based ferrite, Ni—Zn—Cu based ferrite, Mn—Mg based ferrite, Ba based ferrite, Li based ferrite, or the like. The metal magnetic powder may contain one or more selected from the group consisting of iron (Fe), silicon (Si), chromium (Cr), aluminum (Al), and nickel (Ni). For example, the metal magnetic powder may be a Fe—Si—B—Cr based amorphous metal, but is not necessarily limited thereto.

The magnetic material of the body 10 may be a magnetic resin composite including a metal magnetic powder and an insulating resin. The metal magnetic powder may include iron (Fe), chromium (Cr), or silicon (Si) as a main component. For example, the metal magnetic powder may include iron (Fe)-nickel (Ni), iron (Fe), iron (Fe)-chromium (Cr)-silicon (Si), or the like, but are not limited thereto. The insulating resin may include epoxy, polyimide, liquid crystal polymer (LCP), or the like, but is not limited thereto. The metal magnetic powder may be a metal magnetic powder having at least two average particle sizes. Alternatively, the metal magnetic powder may be a metal magnetic powder having at least three average particle sizes. In this case, metal magnetic powders having different sizes may be fully filled in the magnetic resin composite by compression, such that a packing factor of the magnetic resin composite may be increased. As a result, an inductance of the coil component 100 may be increased.

A material or a kind of the support member 20 is not particularly limited as long as the support member 20 may support the coil patterns 21 and 22. For example, the support member 20 may be copper clad laminates (CCL), a polypropylene glycol (PPG) substrate, a ferrite substrate, a metal based soft magnetic substrate, or the like. In addition, the support member 20 may be an insulating substrate formed of an insulating resin. A thermosetting resin such as an epoxy resin, a thermoplastic resin such as polyimide, a resin having a reinforcement material such as a glass fiber or an inorganic filler impregnated in the thermosetting resin and the thermoplastic resin, for example, prepreg, Ajinomoto Build-up Film (ABF), or the like, may be used as the insulating resin. An insulating substrate containing a glass fiber and an epoxy resin may be used as the support member in order to maintain rigidity. However, the support member is not limited thereto. A thickness T of the support member 20 may be 80 μm or less, preferably, 60 μm or less, more preferably, 40 μm or less, but is not limited thereto.

The coil patterns 21 and 22 may allow the coil component 100 to perform various functions through characteristics expressed from the coils. For example, the coil component 100 may be a power inductor. In this case, the coil patterns 21 and 22 may serve to store electricity in a magnetic field form to maintain an output voltage, thereby stabilizing power. The coil pattern 21 and 22 may include a first coil pattern 21 and a second coil pattern 22 disposed on an upper surface and a lower surface of the support member 20, respectively, and the first and second coil patterns 21 and 22 may be electrically connected to each other by a via 23 penetrating through the support member 20.

The coil patterns 21 and 22 may include first conductor layers 21*a* and 22*a*, second conductor layers 21*b* and 22*b*, and third conductor layers 21*c* and 22*c*, respectively.

The first conductor layers 21*a* and 22*a* may be disposed on the support member 20 and have a planar spiral shape.

The second conductor layers 21*b* and 22*b* may be formed on the first conductor layers 21*a* and 22*a*. For example, the second conductor layers 21*b* and 22*b* may be formed on the support member 20 to cover the first conductor layers 21*a* and 22*a*. Similarly, the second conductor layers 21*b* and 22*b* may have a planar spiral shape. The second conductor layers 21*b* and 22*b* may have an asymmetrical volume in a height direction, that is, a thickness direction, as described above.

The third conductor layers 21*c* and 22*c* may cover the second conductor layers 21*b* and 22*b* from the outside of the second conductor layers 21*b* and 22*b*.

The first conductor layers 21*a* and 22*a* to the third conductor layers 21*c* and 22*c* may be formed by plating, and a material of each of the first to third conductor layers may include a conductive material such as copper (Cu), aluminum (Al), silver (Ag), tin (Sn), gold (Au), nickel (Ni), lead (Pb), or an alloy thereof.

The via 23 may penetrate through the support member 20 and may electrically connect the first and second coil patterns 21 and 22 to each other. Therefore, the first and second coil patterns 21 and 22 may be electrically connected to each other to form one coil. A plurality of coil layers 211, 212, 221, and 222 may be electrically connected to each other to form one coil. The via 23 may also include a conductive material such as copper (Cu), aluminum(Al), silver (Ag), tin (Sn), gold (Au), nickel (Ni), lead (Pb), or an alloy thereof. The via 23 may have a cross section of a sandglass shape, a cylindrical shape, or the like.

Although not illustrated, an insulating layer may be formed on the outermost layers of the coil patterns 21 and 22 to protect the coil patterns 21 and 22. The insulating layer may cover each of the coil patterns 21 and 22. A material of the insulating layer may be any material as long as it includes an insulating material. For example, the material of the insulating layer may include an insulating material used for a typical insulating coating, for example, a thermosetting resin such as an epoxy resin, a polyimide resin, or the like, but is not limited thereto.

A through-hole 25 may be formed in a central portion of the support member 20, and a magnetic material may be disposed in the through-hole 25 to form a magnetic core. That is, the central portions of the first and second coil patterns 21 and 22 may be connected to each other without interfering with the support member 20 to form the magnetic core filled with the magnetic material. In this case, the inductance characteristics may be further improved.

The external electrodes 31 and 32 may electrically connect the coil patterns 21 and 22 in the coil component 100 with the electronic device, when the coil component 100 is mounted on the electronic device or the like. The first and second external electrodes 31 and 32 may be connected to leading electrodes of the first and second coil patterns 21 and 22, respectively. The external electrodes 31 and 32 may include a conductive material. For example, the external electrodes 31 and 32 may include conductive resin layers, and plating layers formed on the conductive resin layers, respectively. The conductive resin layer may include one or more conductive metal selected from the group consisting of copper (Cu), nickel (Ni), and silver (Ag), and a thermosetting resin. The plating layer may include one or more selected from the group consisting of nickel (Ni), copper (Cu), and tin (Sn). For example, a nickel (Ni) layer and a tin (Sn) layer may be sequentially formed in the plating layer. However, the order of forming the nickel layer and the tin layer in the plating layer is not limited thereto, and the order of these layers may be mutually changed.

Figure 3:
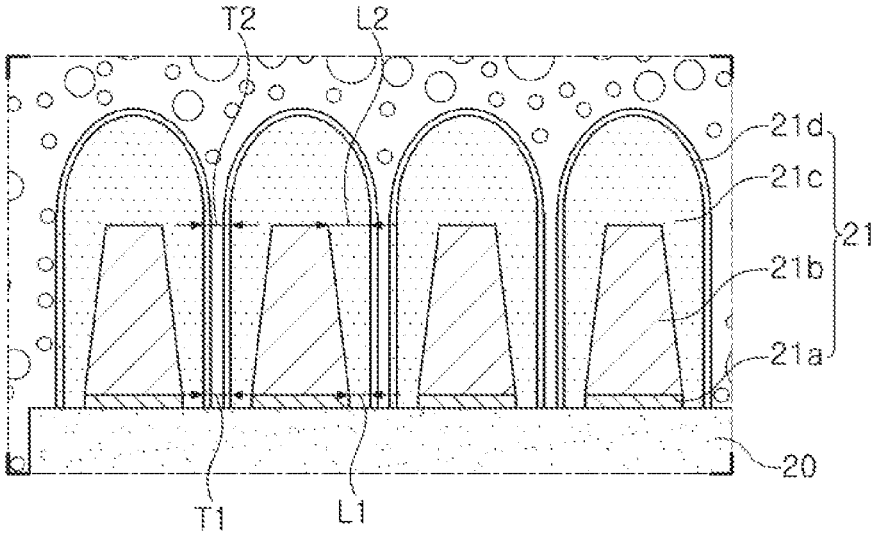
FIG. 3 is an enlarged view illustrating an example of a portion A of the coil component illustrated in FIG. 2.

FIG. 3 is an enlarged view illustrating an example of a portion A of the coil component illustrated in FIG. 2.

Referring to FIG. 3, when viewed from a cut surface in a width-thickness (height) direction of the body 10, the second conductor layer 21*b* may have an area of the lower surface greater than an area of the upper surface. That is, when viewed from a cut surface in a width-thickness (height) direction of the body 10, the second conductor layer 21*b* may have a width of the lower surface longer than a width of the upper surface. Alternatively, when viewed from the cut surface, a side surface of the second conductor layer 21*b* may have a slope.

Alternatively, in the illustrated example, it may be seen that when viewed from the cut surface, the second conductor layer 21*b* has a trapezoidal shape in which a thickness thereof is greater than a width thereof, or a shape similar thereto.

As a result, as described above, the second conductor layer 21*b* may be asymmetric in a height direction, that is, a thickness direction so that a volume of a lower portion is greater than a volume of an upper portion. Accordingly, even in a case in which the third conductor layer 21*c* is formed by a plating method, an upper portion and a lower portion of the third conductor layer 21*c* may be formed to be uniform with each other.

For example, a first width L1 of the third conductor layer 21*c* at a height corresponding to the lower surface of the second conductor layer 21*b* may be thinner than a second width L2 of the third conductor layer 21*c* at a height corresponding to the upper surface of the second conductor layer 21*b*.

Alternatively, a first interval T1 between the third conductor layers 21*c* at the height corresponding to the lower surface of the second conductor layer 21*b* may correspond to a second interval T2 between the third conductive layers 21*c* at the height corresponding to the upper surface of the second conductor layer 21*b*.

That is, when the third conductor layers 21*c* are formed by the plating method, even in the case in which the plating solution is not smoothly supplied toward the position closer to the support member 20, that is, the lower portion of the second conductor layer 21*b* as described above, as volumes of an upper portion and a lower portion of the third conductor layer 21*c* are plated to be different from each other, the coil module 21 including the third conductor layer 21*c* may be formed so that the upper portion and the lower portion have a symmetrical volume, thereby improving reliability of the coil component.

Method for Manufacturing Coil Component

An example of a method for manufacturing a coil component according to an exemplary embodiment in the present disclosure may include forming a coil pattern on a support member and forming a body by covering the support member with a magnetic material.

Figure 5:
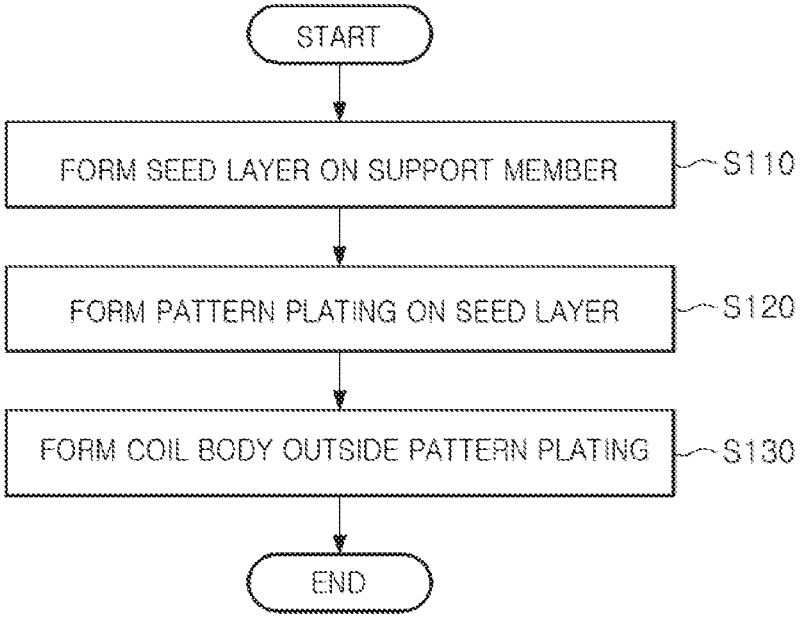
FIG. 5 is a flowchart illustrating an example of a method for manufacturing a coil component according to an exemplary embodiment in the present disclosure.

FIG. 5 is a flowchart illustrating an example of a method for manufacturing a coil component according to an exemplary embodiment in the present disclosure. Referring to FIG. 5, a first conductor layer (e.g., a seed layer) having a planar spiral shape may be formed on the support member (S110), a second conductor layer (pattern plating) may be formed on the seed layer (S120), and a third conductor layer (a coil body) may be then formed to cover the pattern plating from the outside of the pattern plating (S130). Here, the pattern plating (the second conductor layer) may have an asymmetrical shape in which a volume of a lower is greater than a volume of an upper portion as described above.

Hereinafter, the respective operations of the method for manufacturing a coil component illustrated in FIG. 5 will be described in more detail with reference to FIGS. 6 through 8.

Figure 6:
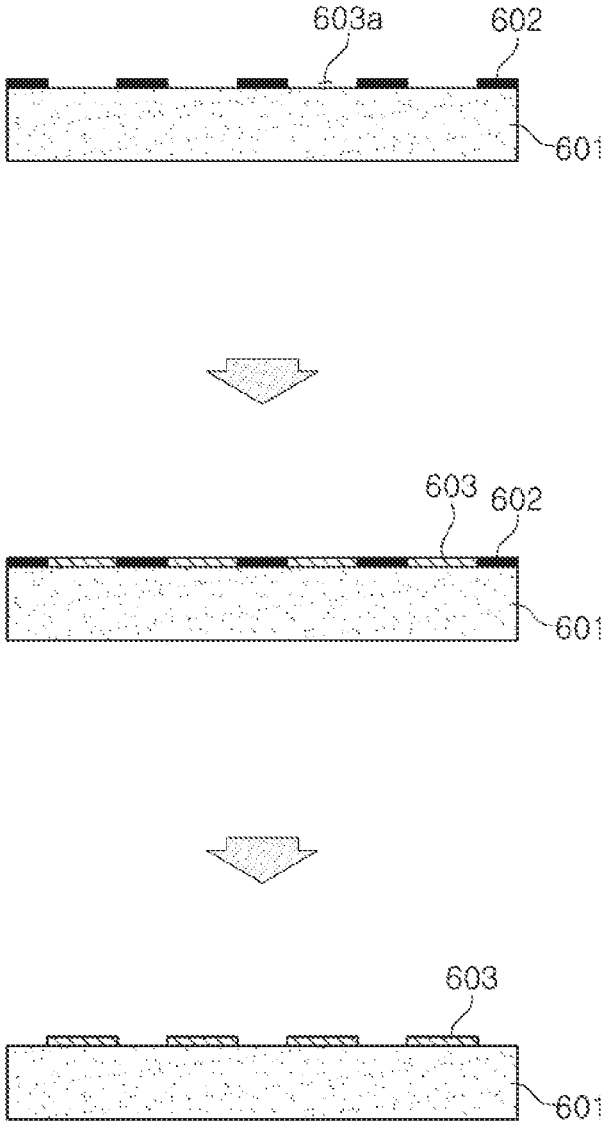
FIG. 6 is a view illustrating an example forming a first conductor layer of a coil pattern according to an exemplary embodiment in the present disclosure.

FIG. 6 is a view illustrating an example forming a first conductor layer of a coil pattern according to an exemplary embodiment in the present disclosure.

Referring to FIG. 6, a resist 601 having an opening 603*a* of a planar spiral shape for forming a first conductor layer 603 may be formed on the support member 20. Thereafter, the opening 603*a* may be filled with plating to form the first conductor layer 603. The resist 601 may be then removed. Through the process as described above, the first conductor layer 603 may be formed. Meanwhile, the resist 601 may be a typical photosensitive resist film.

Figure 7A:
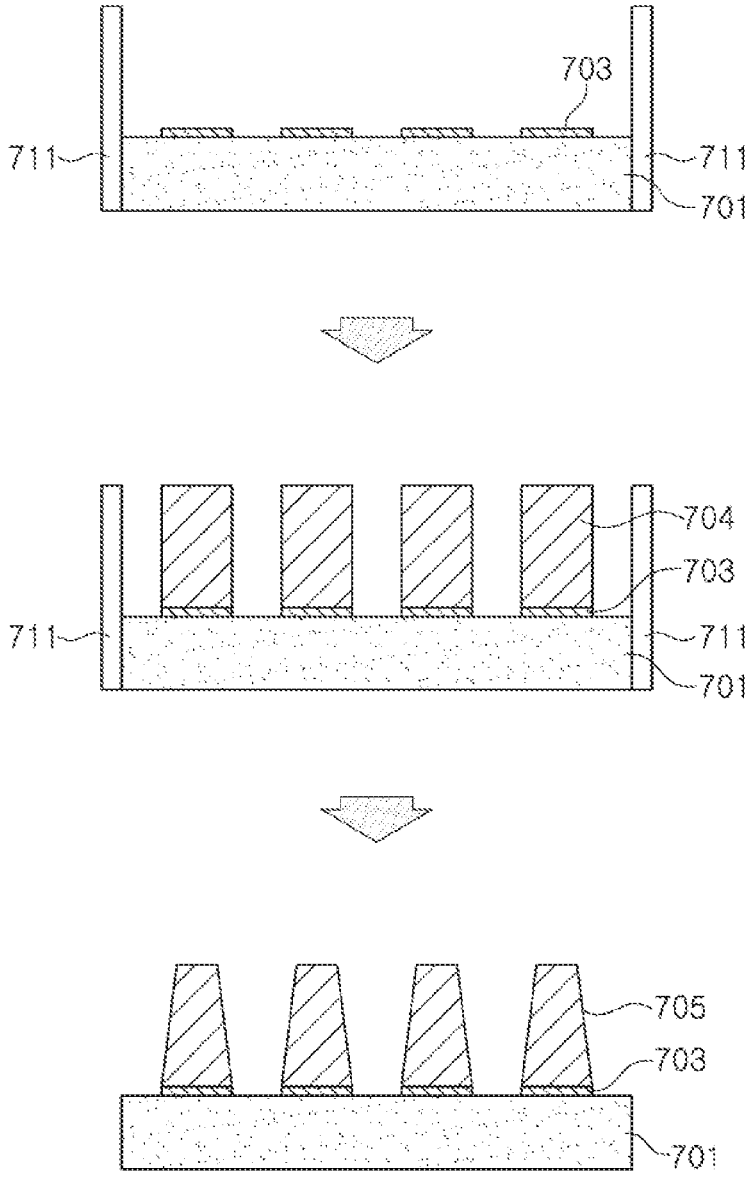
FIGS. 7A and 7B are views illustrating examples forming a second conductor layer of a coil pattern according to an exemplary embodiment in the present disclosure.
Figure 7B:
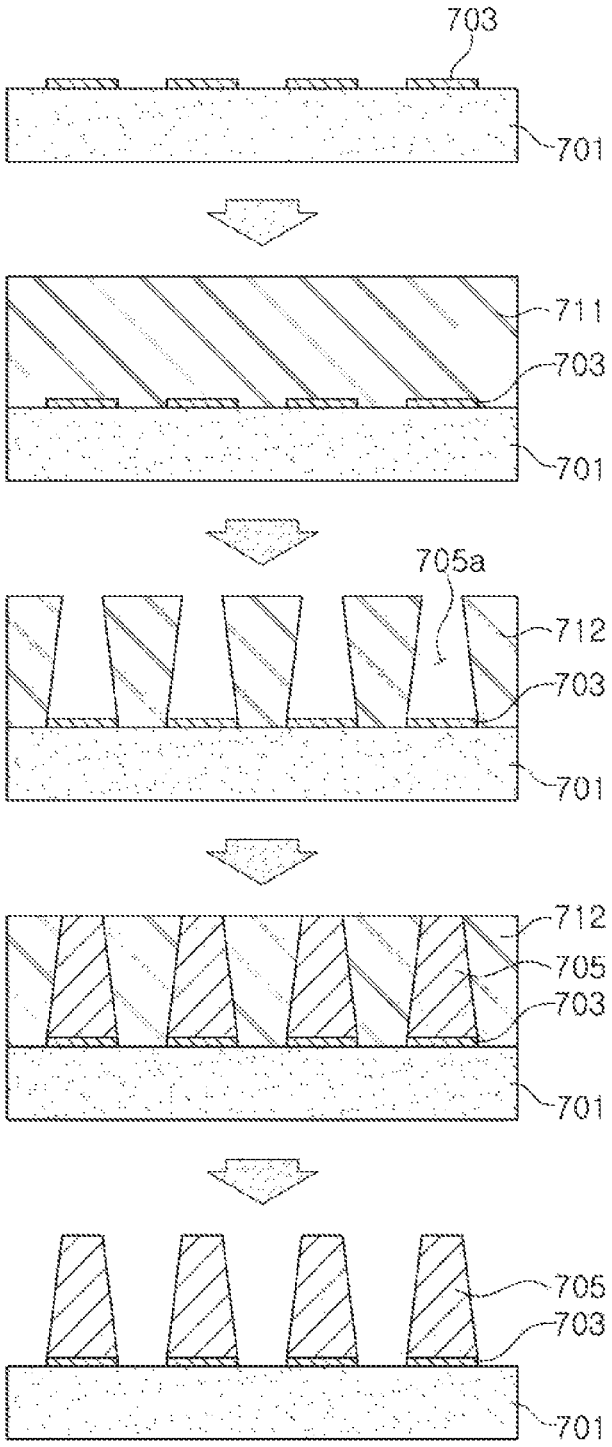

FIGS. 7A and 7B are views illustrating examples forming a second conductor layer of a coil pattern according to an exemplary embodiment in the present disclosure.

FIG. 7A illustrates an example of forming a second conductor layer using an anisotropic plating method.

Referring to FIG. 7A, after dams 711 are formed at both side portions of a support member 701 on which first conductor layers 703 are formed, second conductor layers 704 may be formed by performing plating so that a growth is larger in a thickness direction than a width direction using the first conductor layers 703 as leading lines.

In detail, the second conductor layer 704 may be formed as an anisotropic plating layer having a shape in which growth in a width direction is suppressed and only a growth in a height direction is performed by adjusting current density, concentration of a plating solution, plating speed, and the like at the time of electroplating.

Meanwhile, dams 711 may be similarly known photosensitive resist films, thereby preventing plating short.

Thereafter, a dam 711 may be removed and an outer layer of an upper portion of the second conductor layer 704 may be etched to form the second conductor layer 705 so that the volume of the upper portion is smaller than the volume of the lower portion.

As an example, assuming that an etching amount is a reference etching amount and an etching time is a reference time during a typical etching process, the etching amount may be set to be smaller than the reference etching amount and the etching time may be set to be longer than the reference time in the present example. Accordingly, the etching amount of the upper portion of the second conductor layer 704 may be greater than the etching amount of the lower portion thereof by an etching which is weakly applied. As a result, up-down asymmetrical etching of the second conductor layer 704 may be performed.

According to an exemplary embodiment, such an etching process may be performed at the same time as the process of removing the resist 601 of the first conductor layer (the seed layer). For example, as one etching process, the second conductor layer 705 may be formed by etching the resist 601 of the first conductor layer (the seed layer) and etching the outer layer of the upper portion of the second conductor layer 704.

FIG. 7B illustrates an example of forming a second conductor layer using a plating method using a plating frame.

Referring to FIG. 7B, a plating frame base 711 may be formed on the support member 701 on which the first conductor layers 703 are formed. As an example, a material of the plating frame base 711 may be a material such as a dry film or the like.

Thereafter, plating frames 712 may be formed by exposing the plating frame base 711. That is, the plating frame base 711 may be exposed so that an opening 705*a* having an inverted slope is formed in the plating frame base 711.

As an example, the slope of the opening 705 formed in the plating frame base 711 may be adjusted by adjusting an exposing amount.

For example, assuming that an exposing amount in a case in which the opening 705*a* is exposed at a right angle is a reference exposing amount, the exposure is performed in the present example by setting the exposing amount to be weaker than the reference exposing amount, such that an upper portion of the plating frame base 711 may be cured and a lower portion thereof may be developed. As a result, the opening 705*a* may have the inverted slope, that is, an upper space of the opening may be smaller than a lower space of the opening.

Thereafter, the openings 705*a* may be filled with plating to form the second conductor layers 705, and the plating frames 712 may be removed.

Figure 8:
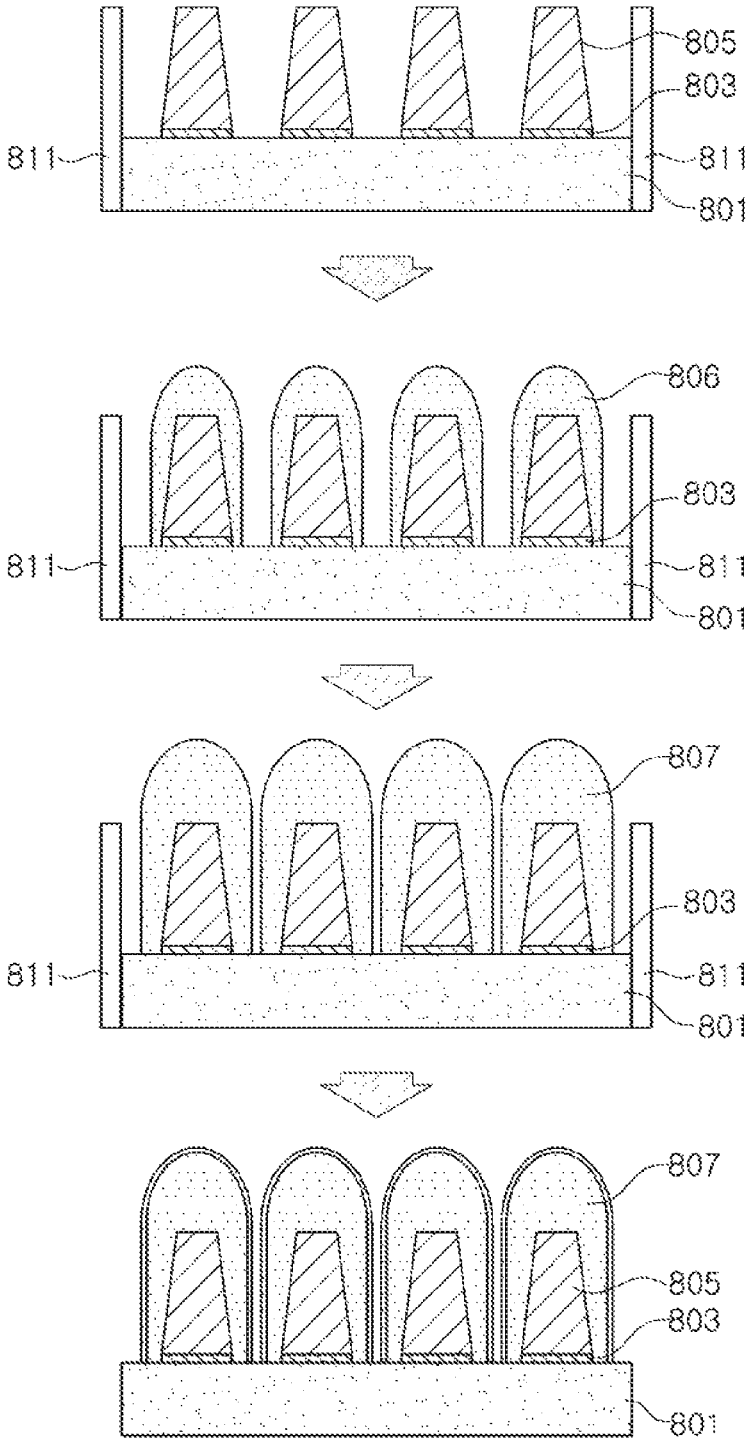
FIG. 8 is a view illustrating an example forming a third conductor layer of a coil pattern according to an exemplary embodiment in the present disclosure.

FIG. 8 is a view illustrating an example forming a third conductor layer of a coil pattern according to an exemplary embodiment in the present disclosure.

Referring to FIG. 8, dams 811 may be formed at both side portions of a support member 801 on which first conductor layers 803 and second conductor layers 805 are formed.

Thereafter, third conductor layers 807 may be formed by performing (806, 807) plating so as to correspond to growths in a width direction and a thickness direction using the second conductor layers 805 as leading lines on the support member 801.

In detail, the third conductor layer 807 may be formed as an isotropic plating layer having a shape in which the growth is performed so that the growth in the width direction and the growth in the thickness direction are similar to each other by adjusting current density, concentration of a plating solution, plating speed, and the like at the time of electroplating. The dams 811 may be then removed. According to an exemplary embodiment, an insulating layer may also be formed at the outermost portion of the coil pattern.

Meanwhile, although not illustrated, the formation of the second coil pattern 22 may be substantially the same as the formation of the first coil pattern 21, and the first coil pattern 21 and the second coil pattern 22 may be simultaneously formed.

Meanwhile, when the coil patterns 21 and 22 are formed, the via 23 may be formed by forming a via hole penetrating through the support member 20 and then performing plating. In addition, after the coil patterns 21 and 22 are formed, insulating layers covering the coil patterns may be formed. The insulating films 24 and 25 may be formed by a suitable method such as a screen printing method, an exposure of a photo-resist (PR), a process through development, a spray applying process, or the like.

Next, magnetic sheets may be stacked on the upper portion and the lower portion of the support member 20 on which the coil patterns 21 and 22 are formed, and the magnetic sheets may be compressed and cured to form the body 10. The magnetic sheets may be manufactured in a sheet shape by mixing metal magnetic powders, insulating resins, and organic materials such as a solvent and the like, with each other to prepare slurry, applying the slurry at a thickness of several ten micrometers onto carrier films by a doctor blade method, and then drying the applied slurry.

Meanwhile, the central portion of the support member 20 may be removed by performing a mechanical drill, a laser drill, a sandblast, a punching process, or the like to form a through-hole 15, and the through-hole 15 may be filled with a magnetic material in the process of compressing and curing the magnetic sheets.

Next, the first and second external electrodes 31 and 32 covering the first surface and the second surface of the body 10 may be formed to be connected to leading electrodes of the first and second coil patterns 21 and 22 which are led to the first surface and the second surface of the body 10, respectively. The external electrodes 31 and 32 may be formed of a paste including a metal having excellent electrical conductivity, and may be formed, for example, by a method for printing a conductive paste including nickel (Ni), copper (Cu), tin (Sn), or silver (Ag), or an alloy thereof. In addition, after the conductive paste is printed, a plating layer may be further formed, and the plating layer may include one or more selected from the group consisting of nickel (Ni), copper (Cu), and tin (Sn). For example, a nickel (Ni) layer and a tin (Sn) layer may be sequentially formed in the plating layer.

Meanwhile, in the present disclosure, the meaning of an "electrical connection" of one component to another component includes a case in which one component is physically connected to another component and a case in which one component is not physically connected to another component. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

In addition, a term "example" used in the present disclosure does not mean the same exemplary embodiment, but is provided in order to emphasize and describe different unique features. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

In addition, terms used in the present disclosure are used only in order to describe an example rather than limiting the scope of the present disclosure. In this case, singular forms include plural forms unless interpreted otherwise in context.

As set forth above, according to the exemplary embodiments in the present disclosure, the coil component and the method for manufacturing the same capable of securing high performance and reliability while being able to be applied to the miniaturized model may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a magnetic material;

a support member disposed in the body; and a coil pattern on the support member in the body, wherein the coil pattern includes:

a first conductor layer formed on the support member and having a planar spiral shape;

a second conductor layer formed on the first conductor layer and having a volume of a lower portion greater than a volume of an upper portion; and a third conductor layer formed to cover the second conductor layer from the outside of the second conductor layer, wherein a width of the second conductor layer decreases from the first conductor layer to a width smaller than a minimum width of the first conductor layer.

2. The coil component of claim 1, wherein, when viewed from a cut surface in a thickness-width direction of the body, the second conductor layer has a width of a lower surface wider than a width of an upper surface.

3. The coil component of claim 1, wherein when viewed from a cut surface in a thickness-width direction of the body, the second conductor layer has a trapezoidal shape in which a height thereof is greater than a width thereof.

4. The coil component of claim 1, wherein when viewed from a cut surface in a thickness-width direction of the body, a side surface of the second conductor layer has a slope.

5. The coil component of claim 1, wherein when viewed from a cut surface in a thickness-width direction of the body, a first width of the third conductor layer at a height corresponding to a lower surface of the second conductor layer is thinner than a second width of the third conductor layer at a height corresponding to an upper surface of the second conductor layer.

6. The coil component of claim 1, wherein when viewed from a cut surface in a thickness-width direction of the body, a first spacing between the third conductor layers at a height corresponding to a lower surface of the second conductor layer is substantially the same as a second spacing between the third conductor layers at a height corresponding to an upper surface of the second conductor layer.

7. The coil component of claim 1, further comprising an insulating layer formed on an outer portion of the third conductor layer to cover the third conductor layer.

8. The coil component of claim 1, wherein the coil pattern includes a first coil pattern and a second coil pattern formed on an upper surface and a lower surface of the support member, respectively, and the first and second coil patterns include the first to third conductor layers, respectively.

9. The coil component of claim 8, wherein the first and second coil patterns are electrically connected to each other by a via penetrating through the support member.

10. A coil component comprising:

a support member; and a coil pattern having a spiral shape and comprising a first conductor layer disposed on the support member, a second conductor layer disposed on the first conductor layer and a third conductor layer disposed on the second conductor layer, wherein a width of the second conductor layer closer to the support member is greater than a width of the second conductor layer away from the support member, wherein a width of the second conductor layer decreases from the first conductor layer to a width smaller than a minimum width of the first conductor layer.

11. The coil component of claim 10, further comprising an insulating layer disposed on the third conductor layer.

12. The coil component of claim 10, wherein a width of the third conductor layer closer to the support member is smaller than the width of the third conductor layer away from the support member such that a spacing between adjacent third conductor layers of the coil pattern is substantially the same in a direction perpendicular to and away from the support member at least to a distance corresponding to a height of the second conductor layer above the support member.

13. The coil component of claim 10, further comprising a body comprising a magnetic material, the body embedding the coil pattern and the support member.

* * * * *